US010316831B2

(12) United States Patent
Bae et al.

(10) Patent No.: US 10,316,831 B2
(45) Date of Patent: Jun. 11, 2019

(54) VALVE ASSEMBLY FOR VARIABLE SWASH PLATE COMPRESSOR

(71) Applicant: Halla Visteon Climate Control Corp., Daejeon (KR)

(72) Inventors: Sang Woo Bae, Daejeon (KR); Eun Gi Son, Daejeon (KR); Je Su Yun, Daejeon (KR); Se Young Song, Daejeon (KR); Young Seop Yoon, Daejeon (KR); Sung Myung Lee, Daejeon (KR); Hew Nam Ahn, Daejeon (KR); Seung Taek Lim, Daejeon (KR)

(73) Assignee: HANON SYSTEMS, Daejeon-si (KR)

( * ) Notice: Subject to any disclaimer, the term of this patent is extended or adjusted under 35 U.S.C. 154(b) by 704 days.

(21) Appl. No.: 14/494,196

(22) Filed: Sep. 23, 2014

(65) Prior Publication Data

US 2015/0086400 A1 Mar. 26, 2015

(30) Foreign Application Priority Data

Sep. 23, 2013 (KR) ..... 10-2013-0112369
Mar. 7, 2014 (KR) ..... 10-2014-0027085
Mar. 19, 2014 (KR) ..... 10-2014-0032247

(51) Int. Cl.
*F04B 1/20* (2006.01)
*F04B 27/08* (2006.01)
*F04B 39/10* (2006.01)

(52) U.S. Cl.
CPC ..... *F04B 1/2042* (2013.01); *F04B 1/2078* (2013.01); *F04B 27/08* (2013.01); *F04B 39/1066* (2013.01); *F04B 39/1073* (2013.01)

(58) Field of Classification Search
CPC .. F04B 39/1073; F04B 53/10; F04B 53/1037; F04B 53/1085
See application file for complete search history.

(56) References Cited

U.S. PATENT DOCUMENTS 4,781,540 A * 11/1988 Ikeda ..... F04B 39/1073 137/855
5,603,611 A 2/1997 Tarutani et al.
5,868,556 A * 2/1999 Umemura ..... F04B 27/0882 417/269
2002/0121189 A1* 9/2002 Murase ..... F04B 27/0878 92/71
2005/0249608 A1* 11/2005 Tagami ..... F04B 27/1009 417/269
2006/0096647 A1 5/2006 Bortoli et al.
(Continued)

FOREIGN PATENT DOCUMENTS

CN 101356368 A 1/2009
EP 0962655 A2 12/1999
(Continued)

*Primary Examiner* — Dominick L Plakkoottam
(74) *Attorney, Agent, or Firm* — Shumaker, Loop & Kendrick, LLP; James D. Miller

(57) ABSTRACT

Disclosed herein is a valve assembly for a variable swash plate compressor. Since an opening hole of a suction reed is enlarged toward a suction port of a valve plate and refrigerant is also introduced into a cylinder bore through the opening hole when the suction port is opened, performance of a compressor may be enhanced by an increase in flow rate.

18 Claims, 9 Drawing Sheets

(56) References Cited

U.S. PATENT DOCUMENTS

| | | | | |
|---|---|---|---|---|
| 2008/0304989 | A1 | 12/2008 | Burk | |
| 2010/0155382 | A1* | 6/2010 | Tanihara | B23K 26/36 219/121.85 |
| 2013/0236342 | A1* | 9/2013 | Obayashi | F04B 39/1073 417/458 |

FOREIGN PATENT DOCUMENTS

| | | | |
|---|---|---|---|
| JP | 2002081381 | A | 3/2002 |
| JP | 2011208511 | A | 10/2011 |
| KR | 2019970006196 | | 2/1997 |
| KR | 20030048228 | A | 6/2003 |
| KR | 20120118247 | A | 10/2012 |
| KR | 20130092880 | A | 8/2013 |

* cited by examiner

VALVE ASSEMBLY FOR VARIABLE SWASH PLATE COMPRESSOR

CROSS-REFERENCE TO RELATED APPLICATIONS

This application claims priority to Korean Patent Application Nos. 10-2014-0027085, 10-2014-0032247, and 10-2013-0112369, filed on Mar. 7, 2014, Mar. 19, 2014, and Sep. 23, 2013, respectively, the disclosures of which are incorporated herein by reference in their entirety.

FIELD OF THE INVENTION

Exemplary embodiments of the present invention relate to a valve assembly for a variable swash plate compressor, and more particularly, to a valve assembly for a variable swash plate compressor, capable of enhancing performance of a compressor through an increase in flow rate and extending a life of the compressor through an improvement of durability thereof.

BACKGROUND OF THE INVENTION

In general, compressors serving to compress refrigerant in vehicle cooling systems have been developed in various forms. The compressors are basically classified into a reciprocating compressor which performs compression by reciprocating motion and a rotary compressor which performs compression by rotary motion, according to a driving method.

There is a swash plate compressor as one type of the reciprocating compressor. The swash plate compressor includes a fixed capacity type swash plate compressor capable of fixing an installation angle of a swash plate and a variable capacity type swash plate compressor capable of changing an inclined angle of a swash plate so as to vary a discharge capacity.

FIG. 1 shows a configuration of a typical variable swash plate compressor. As shown in FIG. 1, a variable swash plate compressor 10 (hereinafter, referred to as "a compressor") includes a cylinder block 20 defining a portion of an external appearance and frame of the compressor 10. A center bore 21 is formed by penetrating the middle of the cylinder block 20 and a rotary shaft 30 is rotatably installed to the center bore 21.

A plurality of cylinder bores 22 is radially arranged with respect to the center bore 21 so as to be formed by penetrating the cylinder block 20. A piston 23 is installed within each of the cylinder bores 22 so as to be capable of linearly reciprocating. The piston 23 has a cylindrical shape and the cylinder bore 22 is a cylindrical space corresponding to the same. Refrigerant is introduced into or compressed and discharged from the cylinder bore 22 by reciprocating motion of the piston 23.

A front housing 40 is coupled to the front of the cylinder block 20. The front housing 40 defines a crank chamber 41 therein together with the cylinder block 20.

A pulley 42 connected to an external power source (not shown) such as an engine by a belt is rotatably installed in the front of the front housing 40. The rotary shaft 30 is rotated along with rotation of the pulley 42.

A rear housing 50 is coupled to the rear of the cylinder block 20. A discharge chamber 51 is defined in the rear housing 50 along a position adjacent to an outer peripheral side edge of the rear housing 50, so as to selectively communicate with the associated cylinder bore 22. A suction chamber 52 is defined radially inward of the discharge chamber 51, namely, at a central portion of the rear housing 50.

In this case, a valve assembly, which includes a valve plate 60, and a suction reed plate and a discharge reed plate respectively installed on both side surfaces of the valve plate, is installed between the cylinder block 20 and the rear housing 50.

The discharge chamber 51 communicates with the associated cylinder bore 22 through each discharge port 61 formed at the valve plate 60 and the suction chamber 52 communicates with the associated cylinder bore 22 through each suction port 62 of the valve plate 60.

A rotor 70 is installed at one side of the rotary shaft 30 and integrally rotates with the rotary shaft 30 during rotation of the rotary shaft 30. The rotor 70 is installed within the crank chamber 41 such that the rotary shaft 30 passes through the middle of the crank chamber. A hinge section 71 is protrusively formed on one surface of the rotor 70.

A swash plate 80 is installed on the rotary shaft 30 in such a way to be spaced apart from the rotor 70. The swash plate 80 is protrusively formed with a hinge receiving section 81 hinge-coupled to the hinge section 71 of the rotor 70. The hinge receiving section 81 of the swash plate 80 is hinge-coupled to the hinge section 71 of the rotor 70 by a hinge pin 72, thereby allowing the swash plate 80 to rotate along with rotation of the rotor 70.

The swash plate 80 is connected to the individual pistons 23 by shoes 82. Refrigerant is introduced into or compressed and discharged from the cylinder bore 22 while the pistons 23 linearly reciprocate within the cylinder bores 22 by rotation of the swash plate 80.

In this case, the swash plate 80 is installed such that an angle of the swash plate 80 is variable according to the rotary shaft 30, so as to enable a discharge amount of refrigerant in the compressor 10 to be regulated. To this end, an opening degree of a passage (not shown), which allows the discharge chamber 51 to communicate with the crank chamber 41, is adjusted by a pressure regulation valve (not shown), and thus an inclined angle of the swash plate 80 is changed by a change in pressure in the crank chamber 41.

The variable swash plate compressor having the above configuration is disclosed in Korean Patent Laid-Open Publication No. 10-2003-0048228 (Jun. 19, 2003) and Korean Patent Publication No. 10-125976 (Apr. 24, 2013).

Hereinafter, the configuration of the valve assembly will be described in more detail.

The valve assembly includes a central valve plate, a suction reed plate installed on a cylinder block side surface of the valve plate, and a discharge reed plate installed on a rear housing side surface of the valve plate.

FIG. 2 is an exploded perspective view illustrating a conventional valve plate 60 and suction reed plate 63. Although not shown, the discharge reed plate is installed on the other side surface of the valve plate 60. The valve plate 60 is a metal plate having a disc shape and is formed with the discharge ports 61 and suction ports 62 corresponding to the respective cylinder bores 22.

A plurality of suction reeds 64 for opening and closing the suction ports 62 of the valve plate 60 is formed in a cut manner on the suction reed plate 63.

The discharge reed plate is formed wherein a plurality of discharge reeds for opening and closing the discharge ports 61 of the valve plate 60 is protrusively formed on an outer periphery of the circular plate covering portions at which the suction ports 62 of the valve plate 60 are formed.

FIG. 3 shows a portion of the valve assembly facing one cylinder bore 22. FIG. 3 shows one suction reed 64, one discharge reed 66, and one suction port 62 and discharge port 61 formed on the valve plate 60 in a state in which the suction reed plate 63, the valve plate 60, and the discharge reed plate are sequentially stacked. Reference numeral 53 is a partition wall formed in the rear housing 50 to partition the suction chamber 52 and the discharge chamber 51.

In the above state, when the piston is moved to a top dead center (suction stroke), a negative pressure is generated in the cylinder bore 22. Consequently, the suction reed 64 opens the suction port 62 while being bent about base end portions 64*c* of leg sections 64*b* toward the cylinder bore 22 so that refrigerant in the suction chamber 52 is introduced into the cylinder bore 22 through the suction port 62. In this case, the discharge reed 66 closes the discharge port 61 so that the refrigerant is smoothly introduced through the suction port 62.

Subsequently, when the piston is moved to a bottom dead center (compression stroke), the suction reed 64 is returned to an original position by a compressed refrigerant pressure so as to close the suction port 62. In this case, the refrigerant pressure acts on the discharge reed 66 through an opening hole 64*a* of the suction reed 64 and the discharge port 61, and thus the discharge reed 66 opens the discharge port 61 while being pushed toward the discharge chamber 51 so that the refrigerant in the cylinder bore 22 is discharged to the discharge chamber 51 through the discharge port 61.

Meanwhile, refrigerant should be rapidly introduced into and discharged from the cylinder bore 22, in order to enhance performance of the compressor. However, when the compressor is merely driven at high speed for increasing a flow rate of refrigerant, there are problems in that noise and pulsation are increased and durability of the compressor is deteriorated.

When the compressor 10 is operated, the suction reed 64 performs an opening and closing operation at a rate of once per one revolution of the rotary shaft 30. Thus, the suction reed 64 performs the opening and closing operation at high speed at a rate of ten times to several hundred times per second according to the operation speed of the compressor 10.

Accordingly, the base end portion 64*c* of the leg section 64*b* of the suction reed 64, namely a connection portion between the suction reed 64 and the suction reed plate 63, is repeatedly folded and unfolded.

According to a result of analyzing stress distribution of the suction reed 64, it may be seen that a stress is concentrated on the base end portion 64*c*. In this case, a maximum principal stress applied to the base end portion 64*c* reaches about 436.69 Mpa.

In addition, since both leg sections 64*b* of the suction reed 64 are arranged in parallel with each other, the leg sections 64*b* have a weak structure in a torsional load acting on the suction reed 64 during the opening and closing operation thereof.

Thus, when fatigue is accumulated due to the repeated opening and closing operation of the suction reed 64, the base end portion 64*c* may be easily broken. Since the suction reed 64 is not normally operated when the base end portion 64*c* is broken, the refrigerant is not normally introduced through the suction port 62 of the valve plate 60. Consequently, since the refrigerant is not normally compressed and discharged, the compressor 10 may not be operated.

SUMMARY OF THE INVENTION

An object of the present invention is to provide a valve assembly for a variable swash plate compressor, capable of enhancing performance of a compressor by changing shapes of components of the valve assembly to increase a flow rate, without an increase in driving speed of the compressor.

Another object of the present invention is to provide a valve assembly for a variable swash plate compressor, capable of extending a service life of a compressor by preventing damage of a base end portion of a suction reed.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with one aspect of the present invention, a valve assembly for a variable swash plate compressor includes a valve plate formed with a suction port and a discharge port, a suction reed plate installed to one side surface of the valve plate, and formed with a suction reed for opening and closing the suction port and an opening hole communicating with the discharge port, and a discharge reed plate installed to the other side surface of the valve plate, and formed with an opening hole communicating with the suction port and a discharge reed for opening and closing the discharge port, wherein the opening hole is enlarged to a position adjacent to the suction port, and a suction refrigerant flow is formed through the opening hole when the suction port is opened.

The suction reed may include a valve section for opening and closing the suction port and leg sections connecting the valve section to the suction reed plate, a catching end, which is caught by a catching hook formed at an edge of a cylinder bore when the suction port is opened, may be protrusively formed at a tip end of the valve section, and the catching end may have a width by which the suction refrigerant flow is capable of being generated through left and right side portions of the catching end when the suction port is opened.

The suction port may have a greater width than a distance between outer sides of both leg sections.

The valve section may have a width enlarged in left and right directions so as to be capable of fully closing the suction port.

The discharge reed may have an increasing width as it approaches a radially outside end portion of the discharge reed plate from a radially inside end portion thereof.

The suction reed may be formed wherein a distance between base end sides of the leg sections is longer than a distance between center lines at the valve section side in width directions of both leg sections.

Each of the leg sections may be formed such that a width at the base end side is smaller than a width at the valve section side.

An outside portion of the opening hole of the suction reed in a radial direction of the suction reed plate may have a semicircular shape, and thus an inside portion of the base end of the leg section may have a smooth round shape.

Both end portions of reed holes surrounding the suction reed may be formed with circular extension holes, and thus an outside portion of the base end of the leg section may have a smooth round shape.

The suction port may include first suction ports which are protrusively formed in an arc shape so as to be convex at both sides thereof, and a second suction port which is protrusively formed in an arc shape so as to be convex radially inward of the valve plate from one side of the first suction ports, and a plurality of arc portions may be formed at an end portion of the suction reed so as to correspond to the suction port.

The suction reed may include a first arc portion which is convexly formed radially inward of the suction reed plate so as to correspond to the second suction port, and second arc portions which are convexly formed at both sides of the first arc portion so as to correspond to the first suction ports.

Each of the second arc portions may be formed with an angle of 45° relative to an imaginary extension line which radially extends via the first arc portion from a center of the suction reed plate.

The first arc portion may have a radius of curvature greater than a radius of curvature of each of the second arc portions.

The radius of curvature of the first arc portion may be 4 mm to 10 mm, and the radius of curvature of each of the second arc portions may be 3 mm to 5 mm.

The suction reed may further include third arc portions which are concavely recessed between the first and second arc portions.

Each of the third arc portions may have a radius of curvature of 4 mm to 10 mm.

In accordance with another aspect of the present invention, a valve assembly for a variable swash plate compressor comprising a cylinder bore and a suction chamber separated from a discharge chamber by a partition wall comprises a valve plate formed with a suction port providing communication between the suction chamber and the cylinder bore and a discharge port providing communication between the discharge chamber and the cylinder bore, a suction reed plate installed to one side surface of the valve plate and formed with a suction reed for opening and closing the suction port and an opening hole communicating with the discharge port, and a discharge reed plate installed to the other side surface of the valve plate and formed with an opening hole communicating with the suction port and a discharge reed for opening and closing the discharge port, wherein the opening hole of the suction reed plate extends radially inwardly toward and at least partially beyond a radially outside edge of the partition wall and to a position adjacent the suction port, wherein a suction refrigerant flow is formed through the opening hole of the suction reed plate when the suction port is opened.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
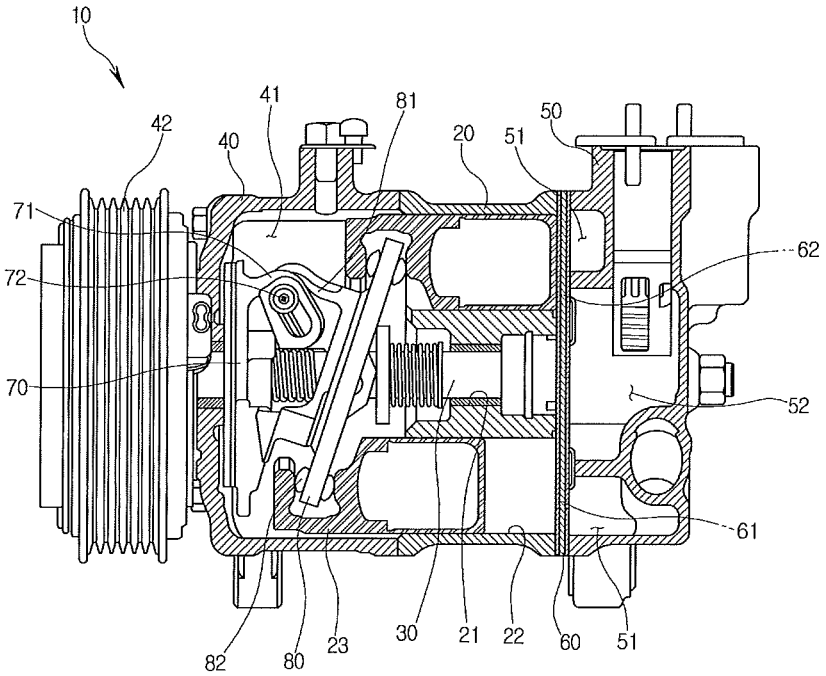
FIG. 1 (PRIOR ART)
FIG. 1 is a view illustrating a configuration of a typical variable swash plate compressor.

Exemplary embodiments of the present invention will be described below in more detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Therefore, it should be understood that the scope and spirit of the present invention can be extended to all variations, equivalents, and replacements in addition to the appended drawings of the present invention. In the description, the thickness of each line or the size of each component illustrated in the drawings may be exaggerated for convenience of description and clarity.

In addition, terms to be described later are terms defined in consideration of functions of the present invention, and these may vary with the intention or practice of a user or an operator. Therefore, such terms should be defined based on the entire content disclosed herein.

Hereinafter, exemplary embodiments of the present invention will be described in more detail with reference to the accompanying drawings.

As shown in FIGS. 4 to 8, refrigerant is introduced and discharged through a rear housing coupled to the rear of a cylinder block in a variable swash plate compressor.

A center bore into which one end of a rotary shaft is inserted is formed at a center of the cylinder block, so that the rotary shaft is rotatably supported by the center bore. A plurality of cylinder bores 22 is radially formed around the center bore.

The cylinder bores 22 are formed by penetrating the cylinder block. A piston is provided in each of the cylinder bores 22 to reciprocate by a swash plate when the rotary shaft is rotated.

The rear housing is formed with a circular partition wall 53 which partitions an inner space of the rear housing into inside spaces and outside spaces in a radial direction thereof. The partition wall 53 traverses the cylinder bores 22 in a state in which the cylinder block is coupled to the rear housing. In spaces partitioned by the partition wall 53, an inside space corresponds to a partial space inside each cylinder bore 22 (inside the cylinder block in a radial direction thereof) and an outside space corresponds to the remaining space outside the cylinder bore 22.

The inside spaces and the outside spaces of the rear housing are respectively suction chambers 52 and discharge chambers 51 for refrigerant. The rear housing is formed with refrigerant inlets connected to the suction chambers 52 and refrigerant outlets connected to the discharge chamber 51.

Meanwhile, a valve plate 100 is provided between the rear housing and the cylinder block. The valve plate 100 has a suction port 110 formed at a portion corresponding to each suction chamber 52 and a discharge port 120 formed at a portion corresponding to each discharge chamber 51. The suction port 110 and the discharge port 120 are formed for each cylinder bore 22.

Reed plates are installed at both sides of the valve plate 100 in order to open and close the suction port 110 and discharge port 120 formed on the valve plate 100. A suction reed plate 200 configured as an intake valve for opening and closing the suction port 110 is installed between the cylinder block and the valve plate 100. A discharge reed plate 300 configured as a discharge valve for opening and closing the discharge port 120 is installed between the valve plate 100 and the rear housing.

The intake valve opens the suction port 110 only toward the cylinder bore 22 so that refrigerant may be supplied from the suction chamber 52 of the rear housing to the cylinder bore 22. The discharge valve opens the discharge port 120 only toward the discharge chamber 51 of the rearing housing so that refrigerant compressed by the piston may be discharged from the cylinder bore 22 to the discharge chamber 51.

Figure 4:
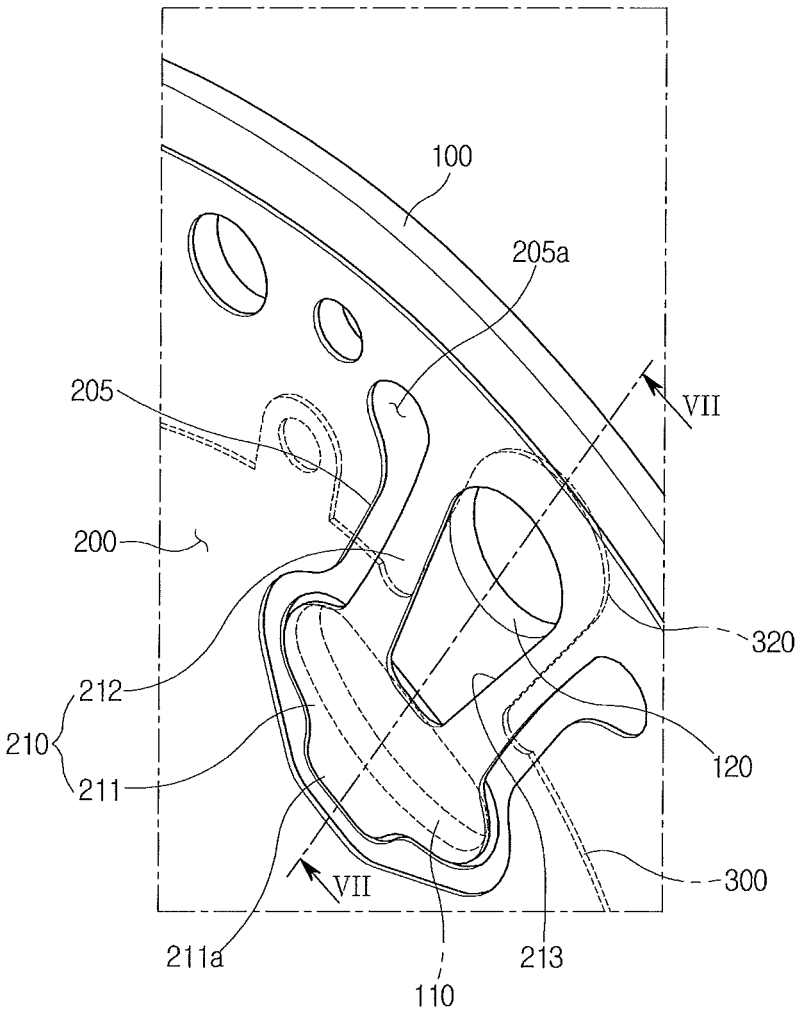
FIG. 4 is a partially enlarged perspective view illustrating a valve assembly according to an embodiment of the present invention.

As shown in FIG. 4, the suction reed plate 200 has a disc shape as a whole and the remaining portion thereof has the same shape.

A plurality of suction reeds 210 for opening and closing the suction ports 110 of the valve plate 100 is formed in a cut manner on the suction reed plate 200. The suction reeds 210 have the same number as the suction ports 110 formed on the valve plate 100. That is, the dedicated suction port 110 is formed for each cylinder bore 22 provided with the piston, and the dedicated suction reed 210 is provided for each suction port 110.

Each of the suction reeds 210 includes a valve section 211 for opening and closing the associated suction port 110 and a pair of leg sections 212 for connecting the valve section 211 to the suction reed plate 200. An opening hole 213 is formed between the pair of leg sections 212 such that a refrigerant pressure in the cylinder bore 22 may act on a discharge reed 320 through the discharge port 120.

That is, the suction reed 210 is formed in such a manner that a reed hole 205 surrounding an outer portion of the suction reed 210 and the opening hole 213 are formed/drilled in the suction reed plate 200.

The discharge port 120 is fully included at an outside portion of the opening hole 213 in a radial direction of the valve plate 100, and an inside portion of the opening hole 213 in the radial direction is enlarged and extends to an adjacent position corresponding to a boundary of the suction port 110 of the valve section 211. That is, when the valve section 211 has no problem in closing the suction port 110 and is spaced apart from the suction port 110, a flow F1 of refrigerant introduced through the suction port 110 may also be achieved through the opening hole 213.

A catching end 211*a* is protrusively formed at an inside tip end of the valve section 211 in the radial direction of the valve plate. A catching hook (not shown) corresponding to the catching end 211*a* is formed at an edge portion of the cylinder bore 22. Accordingly, the catching end 211*a* is caught by the catching hook when the suction reed 201 is opened, thereby enabling a bending amount of the suction reed 210 to be limited.

A width C (see FIG. 8) of the catching end 211*a* is formed to the extent of obtaining minimum rigidity required to maintain a caught state of the catching end 211*a* corresponding to a negative pressure and refrigerant flow pressure acting on the suction reed 210. The width C of the catching end 211*a* is smaller than a width serving as a catching end in a conventional suction reed. Thus, a suction refrigerant flow may also be performed through a portion applied to a difference between the width of the conventional catching end and the width of the catching end 211*a* of the present invention when the valve section 211 is opened. That is, the catching end 211*a* has a width by which a suction refrigerant flow F2 may be generated through left and right side portions of the catching end 211*a* when the suction port 110 is opened.

Figure 5:
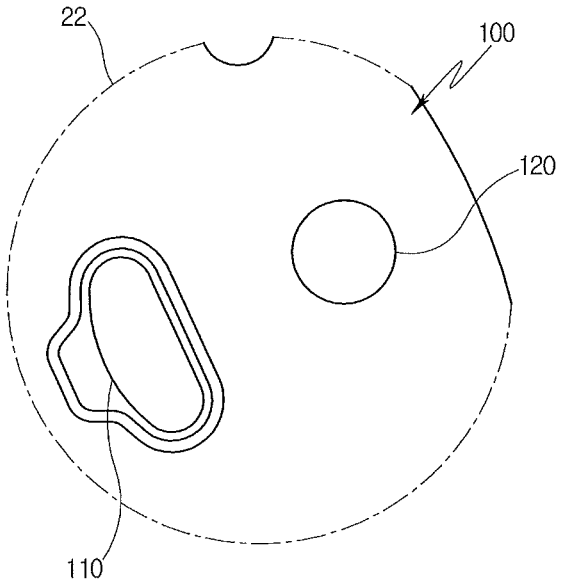
FIG. 5 is a partially enlarged view illustrating a valve plate of the valve assembly according to the embodiment of the present invention.

As shown in FIG. 5, the valve plate 100 has one suction port 110 and one discharge port 120 formed for each position corresponding to the cylinder bore 22.

The suction port 110 is formed radially inward on the valve plate 100 and the discharge port 120 is formed radially outward on the valve plate 100.

The suction port 110 has a slot shape configured such that the width is further enlarged in the left and right directions compared to a conventional suction port. That is, the suction port 110 has a greater width than a distance between outer sides of both leg sections 212 of the suction reed 210.

The discharge port 120 has the same circular shape as the conventional suction port but has an enlarged diameter. To this end, each discharge reed 320 has an outside end portion width B greater than an inside end portion width A, as described below.

Figure 6:
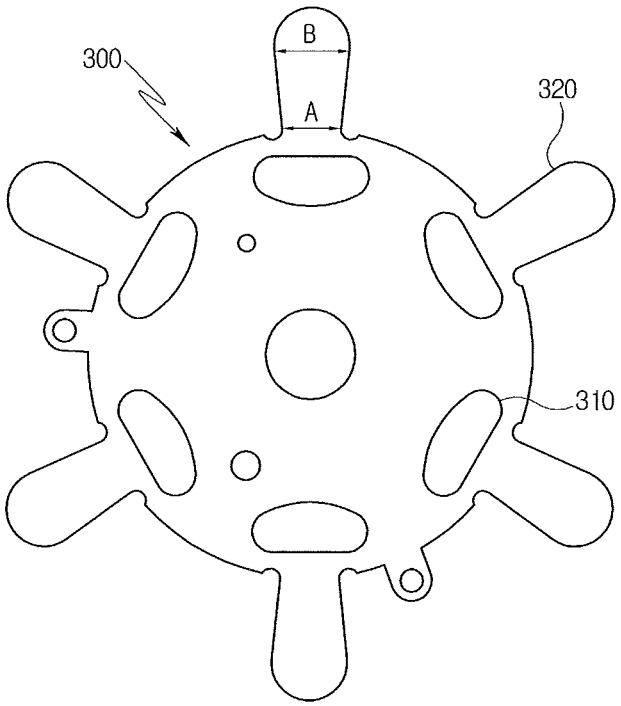
FIG. 6 is a front view illustrating a discharge reed plate of the valve assembly according to the embodiment of the present invention.
Figure 7:
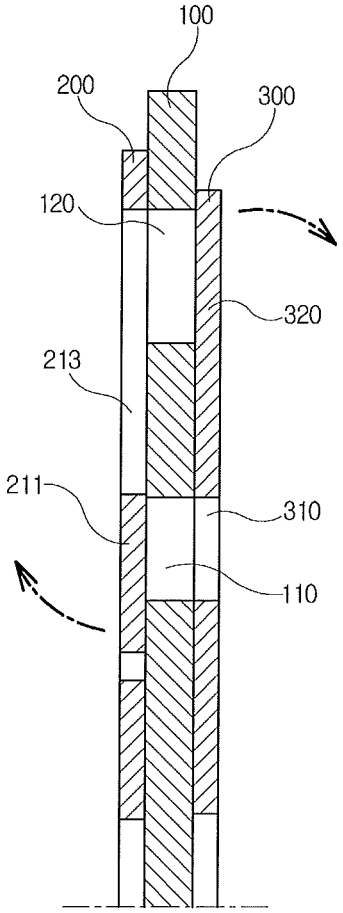
FIG. 7 is a partial cross-sectional view taken along line VII-VII of the valve assembly of FIG. 4 according to the embodiment of the present invention.
Figure 8:
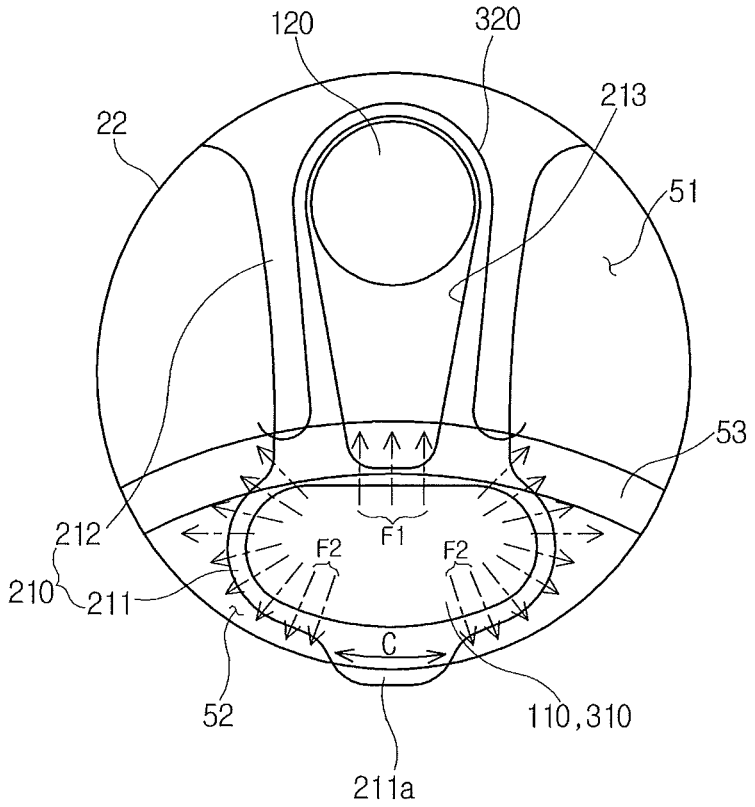
FIG. 8 is a partially enlarged view illustrating the valve assembly applied to one cylinder bore according to the embodiment of the present invention, and corresponds to FIG. 3.

As shown in FIG. 6, the discharge reed plate 300 has the discharge reeds 320 for opening and closing the discharge ports 120, and the discharge reeds 320 protrude from an edge of a disc plate formed to the extent of covering a range in which the suction ports 110 of the valve plate 100 are formed.

Each discharge reed 320 has a semicircular outside end portion, and has the greater width B of the outside end portion than the width A of the inside end portion connected to the disc plate. Consequently, the discharge reed 320 has an area capable of fully closing the discharge ports 120.

An opening hole 310 having the same shape as each suction port 110 of the valve plate 100 is formed radially outward on the disc plate. Thus, when the suction reed 210 is opened, the refrigerant in the suction chamber 52 may be introduced into the cylinder bore 22 through the opening hole 310 and the suction port 110 (also see FIG. 7).

Figure 10:
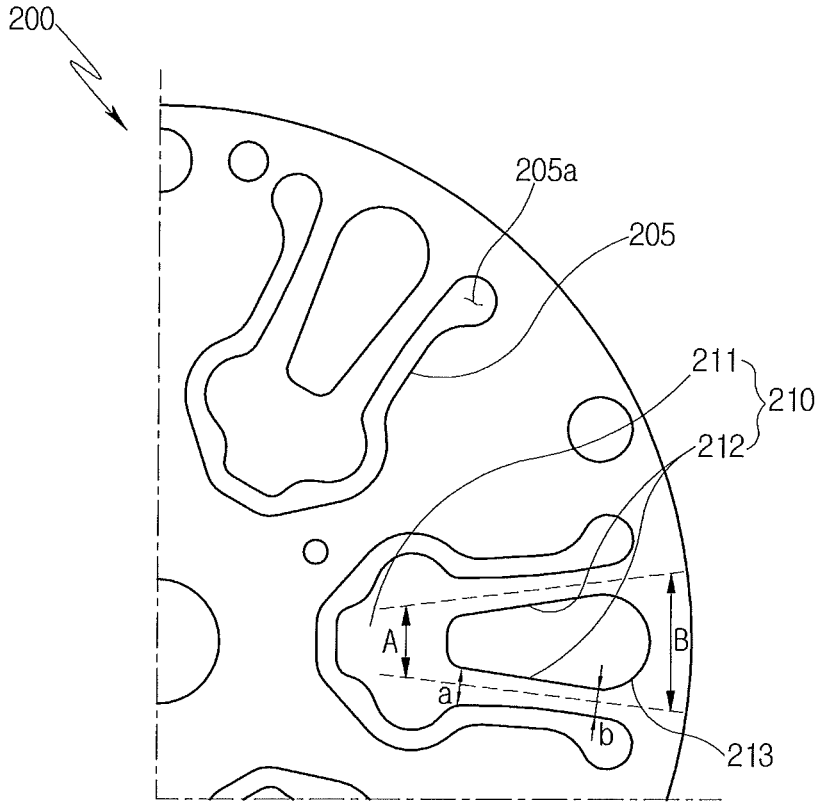
FIG. 10 is a partially enlarged view illustrating a suction reed plate in which a suction reed is formed according to the embodiment of the present invention.

FIG. 10 shows the shape of each suction reed according to the embodiment of the present invention. Both leg sections 212 of the suction reed 210 are not parallel with each other. In the leg sections 212, a width between the leg sections 212 at an end of the leg sections 212 connected to the suction reed plate 200 is greater than a width between the leg sections 212 at an end of the leg sections 212 connected to the valve section 211.

When respective center lines (indicated by dotted lines) in width directions of both leg sections 212 traversing centers of both leg sections 212 in the width directions are set, a distance A between the two center lines at the valve section 211 side is shorter than a distance B between the base end sides of the leg sections 212 (A<B).

In other words, the leg sections 212 of the suction reed 210 are formed to have a shape which is gradually spaced as approaching the base end sides connected to the suction reed plate 200.

Each leg section 212 has a base end side width b smaller than a width a at the valve section 211 side (a>b).

That is, each leg section 212 has a shape configured such that the width is gradually narrowed as approaching the base end side from the valve section 211 side.

The outside portion of the opening hole 213 in the radial direction of the suction reed plate 200 has a semicircular shape. Accordingly, the inside of the base end portion (which means a connection portion between the leg section 212 and the suction reed plate 200) of the leg section 212 has a smooth curved round shape. Therefore, stresses at the base end portion are widely distributed and thus stress concentration at the base end portion is prevented.

In addition, each of both end portions (applied to outside portions of the base end portions of the leg sections 212) of the reed holes 205 surrounding the outside portions of the suction reed 210 is formed with a circular extension hole 205*a* having a greater diameter than a width between the reed hole 205 and a side portion of each leg section 212.

The outside of the base end portion of the leg section 212 has a smooth curved round shape by the extension hole 205*a*. Therefore, stresses at the base end portion are widely distributed and thus stress concentration at the base end portion is prevented.

Figure 11:
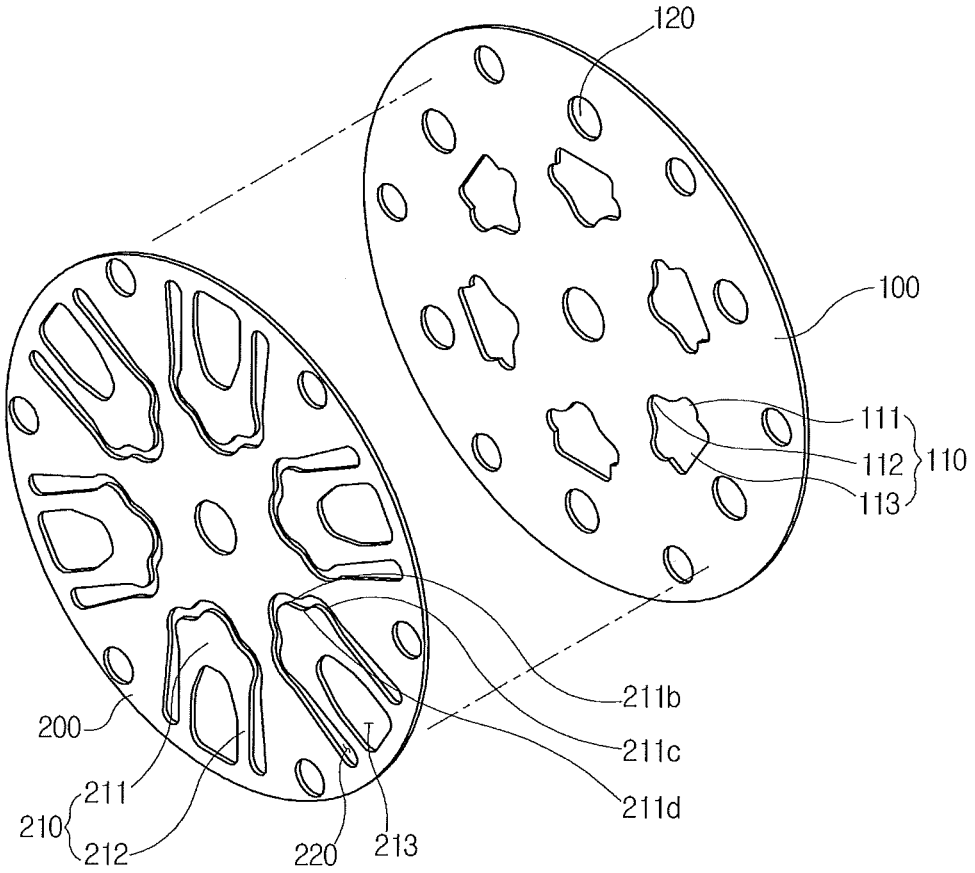
FIG. 11 is an exploded perspective view illustrating a valve plate and a suction reed plate according to another embodiment of the present invention.
Figure 12:
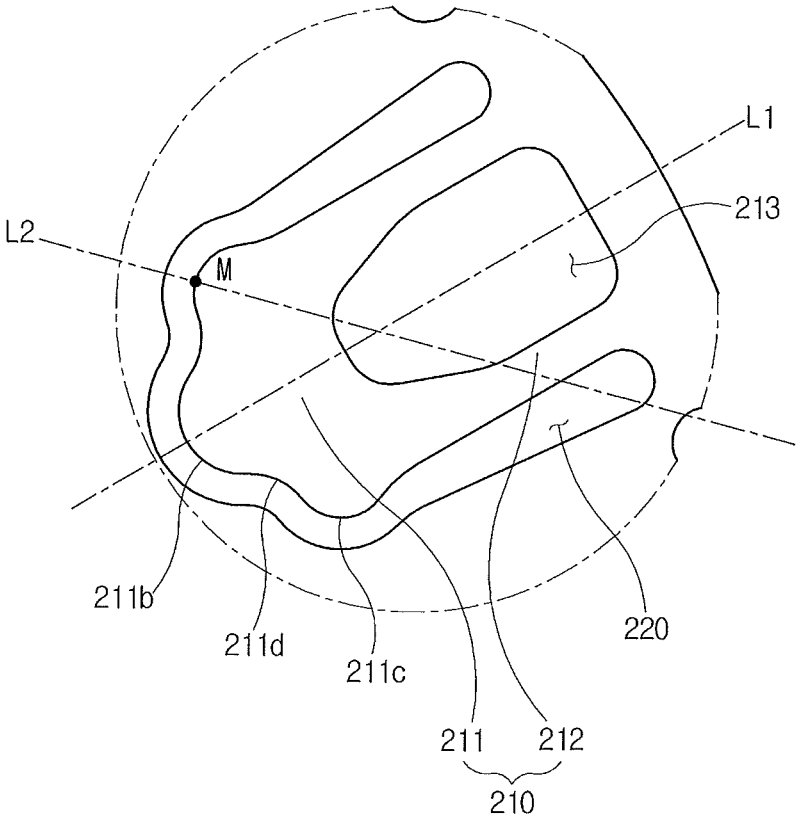
FIG. 12 is an enlarged fragmentary view of a suction reed illustrated in FIG. 11.

FIG. 11 is an exploded perspective view illustrating a valve plate and a suction reed plate according to another embodiment of the present invention. FIG. 12 is an enlarged view of a suction reed illustrated in FIG. 11.

As shown in FIGS. 11 and 12, each suction port 110 of a valve plate 100 includes first suction ports 111 having an arc shape configured such that lengths are long in left and right directions and both ends are convex, and a second suction port 112 which is protrusively formed in a convex arc shape formed radially inward of the valve plate 100 from one side of the first suction ports 111. In addition, the suction port 110 may further include a third rectangular suction port 113 which faces the second suction port 112 and is protrusively formed radially outward of the valve plate 100.

A plurality of arc portions is formed at an end portion of each suction reed 210 so as to correspond to the shape of the suction port 110 of the valve plate 100. In more detail, the arc portions includes a first arc portion 211*b* which is convexly formed radially inward of a suction reed plate 200 so as to correspond to the second suction port 112, and second arc portions 211*c* which are convexly formed at both rear sides of the first arc portion 211*b* so as to correspond to the first suction ports 111.

Here, third arc portions 211*d* are concavely formed between the first and second arc portions 211*b* and 211*c*, in order for the first arc portion 211*b* to be easily elastically deformed. In addition, a radius of curvature of each of the first and third arc portions 211*b* and 211*d* is preferably 4 mm to 10 mm, and a radius of curvature of each of the second arc portions 211*c* is preferably 3 mm to 5 mm so as to be smaller than the radius of curvature of each of the first and third arc portions 211*b* and 211*d*. This is because the first arc portion 211*b* opens and closes the second suction port 112 which is a main passage and the second arc portions 211*c* open and close the first suction ports 111 which are auxiliary passages.

A pair of second arc portions 211*c* is preferably formed with respective angles of 45° relative to an imaginary extension line which radially extends via the first arc portion 211*b* from the center of the suction reed plate 200, such that directions of the passage are not overly diffused when the suction reed 210 is opened. That is, an imaginary line L1 which radially outwardly extends via the first arc portion 211*b* from the center of the suction reed plate 200 forms an angle of 45° with an imaginary line L2 which connects the radius of curvature of the second arc portion 211*c* to an intermediate portion M of the second arc portion 211*c*.

In this case, when the second arc portion 211*c* is formed with an angle less than 45° relative to the first arc portion 211*b*, elastic force of the first arc portion 211*b* is reduced. When the second arc portion 211*c* is formed with an angle greater than 45° relative to the first arc portion 211*b*, a time for which the first arc portion 211*b* is opened and then the second arc portion 211*c* is opened is slightly delayed. For this reason, it may be impossible to immediately respond the request for an increase in suction flow rate.

Reference numeral 220 is a cut section machined to form the suction reed 210 in the suction reed plate 200.

Hereinafter, the operation and effect of the present invention will be described.

The suction stroke of refrigerant is as follows. When the piston is moved to a top dead center and a negative pressure is generated in the cylinder bore 22, the suction reed 210 is bent toward the cylinder bore 22 while the valve section 211 is spaced apart from the valve plate 100, so that the suction port 110 is opened.

The valve section 211 of the suction reed 210 is maintained in a state spaced apart from the suction port 110 by a predetermined distance in such a manner that the catching end 211*a* is caught by the catching hook of the cylinder block in a state in which the suction port 110 is opened. In this state, the refrigerant is introduced through the suction port 110. Since the suction port 110 has a slot shape enlarged in the left and right directions, a refrigerant introduction amount is increased by an increase of the area of the suction port.

Particularly, since the radially inside end portion of the opening hole 213 of the suction reed 210 is formed adjacent to the suction port 110, the refrigerant introduced into the suction port 110 may also be introduced into the cylinder bore 22 through the opening hole 213. That is, a portion closed by the conventional suction reed is opened by extension of the opening hole 213, and thus a new refrigerant flow F1 is generated through the portion. Consequently, a suction flow rate of refrigerant may be increased (see FIG. 8).

In addition, the width of the catching end 211*a* maintained in a caught state when the suction reed 210 is opened is reduced, and thus a portion in which the refrigerant may flow is formed at the tip end portion of the valve section 211, in more detail, at both portions of the catching end 211*a*. Accordingly, since a new refrigerant flow F2 is generated through a new flow space obtained by the reduction of the width of the catching end, the suction flow rate of refrigerant may be increased.

Figure 3:
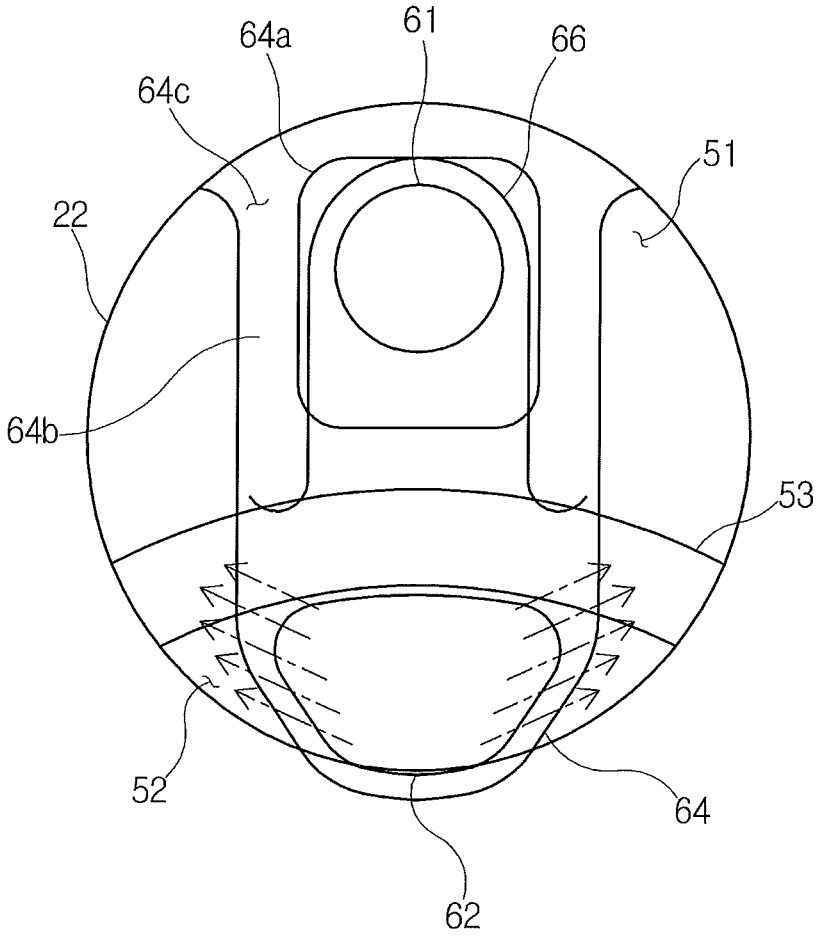
FIG. 3 (PRIOR ART)
FIG. 3 is a partially enlarged view illustrating the conventional valve assembly applied to one cylinder bore.

That is, in the related art, the refrigerant flow is present only in the left and right directions (directions indicated by arrows in FIG. 3) of the suction port, and is hardly present inwardly and outwardly in the radial direction (which means the radial direction of the suction reed plate). However, in the present invention, the refrigerant flow F2 is also present radially inwardly (in the left and right side portions of the catching end 211*a*) as well as both directions of the suction port. Particularly, the refrigerant flow F1 is actively performed radially outwardly (in the portion of the opening hole 213 side).

Figure 9:
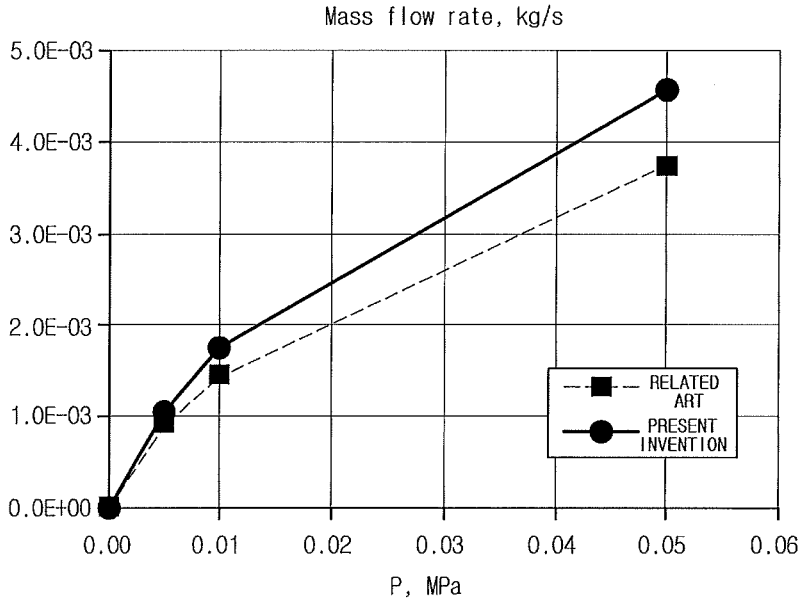
FIG. 9 is a flow rate-pressure graph of a compressor to which the related art (dotted line) and the present invention (solid line) are applied.

FIG. 9 is a graph illustrating a relation between the suction refrigerant flow rate and the pressure according to the related art and the present invention. In FIG. 9, the dotted line refers to the related art and the solid line refers to the present invention. In comparison with two lines, it may be seen that a pressure required to reach the same flow rate is reduced in the present invention compared to the related art. That is, it may be seen that the present invention generates a greater flow rate under the same pressure condition.

Meanwhile, since the discharge port 120 of the present invention has an increased area compared to the conventional discharge port, the refrigerant in the cylinder bore 22 may be more smoothly discharged to the discharge chamber 51 of the rear housing through the discharge port 120 when the compression is performed by the piston.

As described above, according to the present invention, the suction flow may be actively performed through the extension of the suction port 110 and the improvement of the shape of the suction reed 210 and the discharge flow may be smoothly performed through the extension of the discharge port 120. Accordingly, when the compressor is driven under the same conditions, the performance of the compressor may be enhanced by the increase of refrigerant which is introduced, compressed, and discharged.

It may be possible to reduce operation noise and pulsation since a method of increasing the driving speed of the compressor is not adopted when the increase in refrigerant flow rate is promoted for enhancing the performance of the compressor. The durability of the compressor may be improved.

In addition, when the suction reed 210 is opened and closed, the leg sections 212 of the suction reed 210 are formed to have a shape which is gradually spaced as approaching the base end sides from the valve section 211 (A<B) and thus torsional rigidity of the suction reed 210 is improved.

When the suction negative pressure and the refrigerant pressure do not uniformly act on the entirety of the valve section 211, the valve section 211 is inclined and torsion is generated in the leg sections 212. However, it may be possible to reliably correspond to the torsion generated in the valve section 211 since the distance between the both leg sections 212 is gradually increased as approaching the base end portions.

Accordingly, it may be possible to prevent stresses from being concentrated at the base ends of the leg sections 212 due to torsion deformation and thus to prevent fatigue from being accumulated.

In addition, since each leg section 212 has the base end side width b smaller than the width a at the valve section 211 side, the base end side is relatively flexible and thus the stresses are prevented from being concentrated at the base end side.

The inside of the base end portion of the leg section 212 has a smooth curved round shape since the outside portion of the opening hole 213 in the radial direction of the suction reed plate 200 has a semicircular shape. Therefore, the stresses at the inside of the base end portion are effectively distributed and thus stress concentration at the inside of the base end portion is prevented.

The outside of the base end portion of the leg section 212 has a smooth curved round shape since both end portions of the reed holes 205 are formed with the extension holes 205*a*. Therefore, the stresses at the outside of the base end portion are effectively distributed and thus stress concentration at the outside of the base end portion is prevented.

As described above, the stress concentration at the base end portion of the leg section 212 is prevented by various shape factors of the suction reed 210 and the stresses are distributed to the peripheries of the base end portion. Consequently, damage of the leg section 212 caused by accumulation of fatigue is prevented.

According to a result of analyzing stress distribution, the maximum principal stress applied to the base end of the leg section 212 is 337.23 Mpa. Therefore, it may be seen that the maximum principal stress is reduced compared to the maximum principal stress of 436.69 Mpa applied to the same portion in the related art.

Meanwhile, according to another embodiment of the present invention, the suction reed 210 is elastically deformed by the pressure of the suction refrigerant during the suction stroke to open the suction port 110. In this case, the first arc portion 211*b* first opens the second suction port 112 while being elastically deformed toward the cylinder bore. Subsequently, when the pressure of the suction refrigerant is increased, the second arc portions 211*c* are elastically deformed to open the first suction ports 111 together with the first arc portion 211*b*.

In this case, since the circumferential width of each first suction port 111 is greater than the circumferential width of the second suction port 112 (here, the first suction port being two portions), the refrigerant introduced through the first suction port 111 is uniformly introduced into the cylinder bore along the edge of the first suction port 111 without obstruction of the flow of the refrigerant introduced through the second suction port 112.

That is, according to the embodiment of the present invention, the refrigerant is introduced through the first suction port 111 as well as the second suction port 112 corresponding to the conventional suction port. Accordingly, the flow rate of the suction refrigerant may be increased and thus the performance of the compressor may be enhanced.

Figure 2:
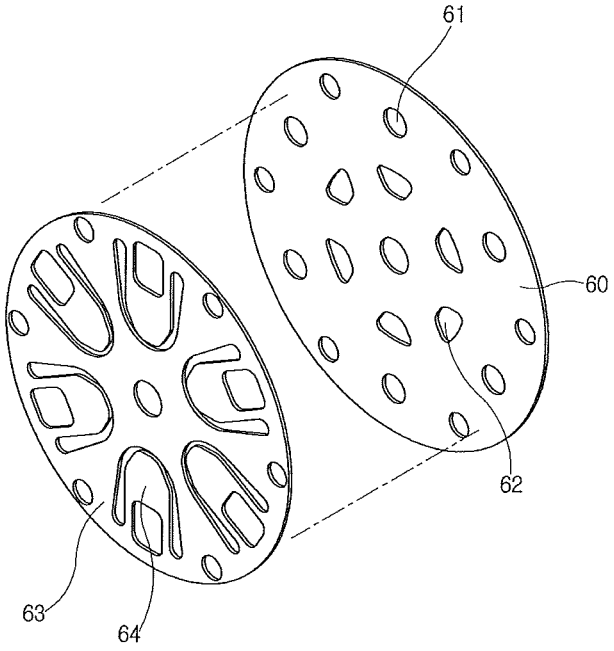
FIG. 2 (PRIOR ART)
FIG. 2 is an exploded perspective view illustrating a conventional valve assembly (a discharge reed plate being not shown)

For example, in the compressor adopting the conventional suction reed 64 shown in FIG. 2, the compressor exhibits performance of 4220 W at 800 rpm and 5480 W at 2000 rpm. However, it may be seen that the compressor adopting the suction reed 210 according to the embodiment of FIG. 11 exhibits excellent performance of 4720 W at 800 rpm and 6150 W at 2000 rpm.

As is apparent from the above description, an area of a suction port is increased, and thus a suction flow rate of refrigerant is increased.

Since an area of a valve section of a section reed is increased according to the increase of the area of the suction port, the suction port may be reliably opened and closed.

Since an opening hole of the suction reed is enlarged toward the valve section to be formed adjacent to the suction port of a valve plate, a flow of refrigerant is further generated through the opening hole, thereby increasing the suction flow rate.

In addition, an area of a discharge port is increased, and thus a discharge flow rate of refrigerant is increased.

Since an area of a valve section of a discharge reed is increased according to the increase of the area of the discharge port, the discharge port may be reliably opened and closed.

Accordingly, refrigerant is smoothly introduced and discharged, and thus the suction and discharge flow rates of refrigerant are increased. As a result, performance of a compressor may be enhanced.

Since the performance of the compressor is enhanced without an increase in driving speed of the compressor, noise and pulsation caused by the mere increase of the driving speed of the compressor may be prevented.

In addition, since stresses applied to a base end portion of the suction reed are easily distributed, the base end portion of the suction reed has a reduced maximum principal stress applied thereto so as to prevent damage of the suction reed.

Since a series of processes in which the refrigerant is introduced, compressed, and discharged are normally performed by the prevention of the damage of the suction reed, the compressor may be normally operated. As a result, a service life of the compressor is extended.

Since durability of the suction reed is improved with no change of material, production costs of the compressor may be greatly reduced.

The suction port of the refrigerant may be more accurately and stably opened and closed by an improvement in rigidity against a torsional load of the suction reed.

In addition, according to an embodiment of the present invention, the refrigerant is uniformly introduced into cylinder bores through many portions of the suction port when the suction reed is opened. Thus, fluidity of the introduced refrigerant is increased and the suction flow rate is increased. Consequently, the performance of the compressor may be enhanced.

While the present invention has been described with respect to the specific embodiments, it will be apparent to those skilled in the art that various changes and modifications may be made without departing from the spirit and scope of the invention as defined in the following claims.

What is claimed is:

1. A valve assembly for a variable swash plate compressor, the valve assembly comprising:

a valve plate formed with a suction port and a discharge port;

a suction reed plate installed on a first side surface of the valve plate and formed with a suction reed for opening and closing the suction port and an opening hole communicating with the discharge port; and a discharge reed plate installed on a second side surface of the valve plate and formed with an opening hole communicating with the suction port and a discharge reed for opening and closing the discharge port, wherein the opening hole of the suction reed plate extends radially inwardly to a position adjacent a boundary of the suction port, and wherein a suction refrigerant flow is formed through the opening hole of the suction reed plate when the suction port is opened, wherein the suction refrigerant flow flows from the suction port toward the opening hole of the suction reed plate by passing between the valve plate and the suction reed, wherein the suction reed includes a valve section for opening and closing the suction port and a pair of leg sections connecting the valve section to the suction reed plate, wherein an inside edge portion of a base end of each of the leg sections and an outside edge portion of the base end of each of the leg sections are arranged in alignment along a circumferential direction of the suction reed plate, wherein a radially outside portion of the opening hole of the suction reed has a semicircular shape, and the inside edge portion of the base end of each of the leg sections has a round shape corresponding to the semicircular shape of the opening hole, and wherein both end portions of a reed hole surrounding and defining a perimeter of the suction reed have a semicircular shape, and the outside edge portion of the base end of each of the leg sections has a round shape corresponding to the shape of the end portions of the reed hole.

2. The valve assembly according to claim 1, the suction reed further comprising:

a catching end protrusively formed at a tip end of the valve section, wherein the catching end cooperates with a catching hook formed on an edge of a cylinder bore of the variable swash plate compressor when the suction port is opened to limit a bending of the suction reed, wherein the catching end has a width wherein the suction refrigerant flow is flowable through the suction port to either lateral side of the catching end when the suction port is opened.

3. The valve assembly according to claim 2, wherein the suction port has a width greater than a distance from an outer side edge of a first one of the leg sections to an outer side edge of a second one of the leg sections.

4. The valve assembly according to claim 3, wherein the valve section of the suction reed has a width enlarged in each lateral direction to fully close the suction port.

5. The valve assembly according to claim 1, wherein a radially outside end portion of the discharge reed has a width greater than a radially inside end portion thereof.

6. The valve assembly according to claim 2, wherein a first centerline extends along a central axis of a first one of the leg sections and a second centerline extends along a central axis of a second one of the leg sections; and wherein a distance between the first centerline and the second centerline at the base ends of the leg sections is greater than a distance between the first centerline and the second centerline at ends of the leg sections having the valve section coupled thereto.

7. The valve assembly according to claim 6, wherein each of the leg sections has a width at the base end thereof that is smaller than a width of each of the leg sections at the end thereof coupled to the valve section.

8. The valve assembly according to claim 1, wherein the suction port comprises a pair of first suction ports, wherein each first suction port is protrusively formed at one lateral side of the suction port and has a convex arcuate shape; wherein a second suction port is protrusively formed at a radial inside end of the suction port, wherein the second suction port has a convex arcuate shape and is formed radially inward from one side of each of the first suction ports; and wherein a plurality of arc portions is formed at an end portion of the suction reed to correspond to the suction port.

9. The valve assembly according to claim 8, wherein the suction reed comprises a first arc portion and a pair of second arc portions, wherein the first arc portion is convexly formed at a radial inside end of the suction reed to correspond to the second suction port and each of the second arc portions is convexly formed to one lateral side of the first arc portion to correspond to the pair of the first suction ports.

10. The valve assembly according to claim 9, wherein each of the second arc portions extend in a direction angled 45° relative to an extension line which radially extends through the first arc portion from a center of the suction reed plate.

11. The valve assembly according to claim 9, wherein the first arc portion has a radius of curvature greater than a radius of curvature of each of the second arc portions.

12. The valve assembly according to claim 11, wherein the radius of curvature of the first arc portion is 4 mm to 10 mm, and the radius of curvature of each of the second arc portions is 3 mm to 5 mm.

13. The valve assembly according to claim 9, wherein the suction reed further comprises third arc portions which are concavely recessed between the first arc portion and the second arc portions to each lateral side of the first arc portion.

14. The valve assembly according to claim 13, wherein each of the third arc portions has a radius of curvature of 4 mm to 10 mm.

15. A valve assembly for a variable swash plate compressor, the variable swash plate compressor comprising a cylinder bore and a suction chamber separated from a discharge chamber by a partition wall, the valve assembly comprising:

a valve plate formed with a suction port providing communication between the suction chamber and the cylinder bore and a discharge port providing communication between the discharge chamber and the cylinder bore;

a suction reed plate installed on a first side surface of the valve plate and formed with a suction reed for opening and closing the suction port and an opening hole communicating with the discharge port; and a discharge reed plate installed on a second side surface of the valve plate and formed with an opening hole communicating with the suction port and a discharge reed for opening and closing the discharge port, wherein the opening hole of the suction reed plate extends radially inwardly toward and at least partially beyond a radially outside edge of the partition wall and to a position adjacent a boundary of the suction port, wherein a suction refrigerant flow is formed through the opening hole of the suction reed plate when the suction port is opened, wherein the suction refrigerant flow flows from the suction port toward the opening hole of the suction reed plate by passing between the valve plate and the suction reed, wherein the suction reed includes a valve section for opening and closing the suction port and a pair of leg sections connecting the valve section to the suction reed plate, wherein an inside edge portion of a base end of each of the leg sections and an outside edge portion of the base end of each of the leg sections are arranged in alignment along a circumferential direction of the suction reed plate, wherein a radially outside portion of the opening hole of the suction reed has a semicircular shape, and the inside edge portion of the base end of each of the leg sections has a round shape corresponding to the semicircular shape of the opening hole, and wherein both end portions of a reed hole surrounding and defining a perimeter of the suction reed have a semicircular shape, and the outside edge portion of the base end of each of the leg sections has a round shape corresponding to the shape of the end portions of the reed hole.

16. The valve assembly according to claim 15, wherein the opening hole of the suction reed plate is formed between the leg sections and defines the inside edge of each of the leg sections, wherein the leg sections are angled with respect to each other.

17. The valve assembly according to claim 16, wherein the opening hole of the suction reed decreases in width as it extends radially inwardly toward the suction port.

18. The valve assembly according to claim 16, wherein a catching end is protrusively formed at a radially inside end of the valve section of the suction reed, wherein the catching end has a width wherein the suction refrigerant flow is capable of being generated through the suction port to either lateral side of the catching end when the suction port is opened.

* * * * *